US011054231B2

(12) United States Patent
Habel et al.

(10) Patent No.: US 11,054,231 B2
(45) Date of Patent: Jul. 6, 2021

(54) STUN GRENADE HAVING AN ADJUSTABLE SWITCH MECHANISM TO CONNECT DIFFERENT EFFECT CHAMBERS SIMULTANEOUSLY TO A DELAY SET

(71) Applicant: RHEINMETALL WAFFE MUNITION GMBH, Unterluess (DE)

(72) Inventors: Frank Habel, Hohnstorf (DE); Mathias Koschmieder, Koethel (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 41 days.

(21) Appl. No.: 16/664,234

(22) Filed: Oct. 25, 2019

(65) Prior Publication Data

US 2020/0056869 A1 Feb. 20, 2020

Related U.S. Application Data

(63) Continuation of application No. PCT/EP2018/060031, filed on Apr. 19, 2018.

(30) Foreign Application Priority Data

Apr. 26, 2017 (DE) ..... 102017108938.1

(51) Int. Cl.

| | |
|---|---|
| ***F42B 27/00*** | (2006.01) |
| ***F42B 12/42*** | (2006.01) |
| ***F42C 15/34*** | (2006.01) |
| ***F42C 19/08*** | (2006.01) |

(52) U.S. Cl.

CPC ..... *F42B 27/00* (2013.01); *F42B 12/42* (2013.01); *F42C 15/34* (2013.01); *F42C 19/0807* (2013.01)

(58) Field of Classification Search

CPC .. F42B 27/00; F42B 12/42; F42B 4/16; F42B 4/26; F42B 12/36; F42B 8/26; F42C 15/34; F42C 19/0807; F42C 19/08

USPC ..... 102/334, 364, 365, 498, 445, 482, 487

See application file for complete search history.

(56) References Cited

U.S. PATENT DOCUMENTS

| | | | | | |
|---|---|---|---|---|---|
| 4,333,401 | A * | 6/1982 | Byers | F42C 14/02 | 102/487 |
| 4,947,753 | A * | 8/1990 | Nixon, III | F42B 8/26 | 102/269 |
| 4,976,201 | A * | 12/1990 | Hamilton | F42B 12/36 | 102/275.3 |
| 5,085,147 | A * | 2/1992 | Gold | F42B 12/36 | 102/486 |

(Continued)

FOREIGN PATENT DOCUMENTS

| | | |
|---|---|---|
| DE | 213375 U1 | 12/1992 |
| DE | 213376 U1 | 12/1992 |

(Continued)

*Primary Examiner* — Michael D David

(74) *Attorney, Agent, or Firm* — Muncy, Geissler, Olds & Lowe, P.C.

(57) ABSTRACT

A stun grenade for individual adjustment and situation-dependent adaptation of the number of active masses in situ. A switch mechanism is built into the stun grenade, enabling the simultaneous activation of different chambers inside the stun grenade in order to adjust the effect. The switch mechanism is formed by a tube and peripherally integrated boreholes and grooves. A different number of the chambers in the stun grenade is activated by the switch mechanism, thereby increasing or decreasing the active power.

8 Claims, 3 Drawing Sheets

(56) References Cited

U.S. PATENT DOCUMENTS

| | | | | |
|---|---|---|---|---|
| 5,654,523 | A * | 8/1997 | Brunn | F42B 8/26 102/368 |
| 6,595,139 | B1 * | 7/2003 | Haeselich | F42B 27/00 102/498 |
| 7,387,073 | B2 * | 6/2008 | Bodley | F42B 8/00 102/487 |
| 7,963,227 | B1 * | 6/2011 | Brunn | F42B 27/00 102/498 |
| 8,091,480 | B2 * | 1/2012 | Lubbers | F42B 12/36 102/368 |
| 8,752,485 | B2 * | 6/2014 | Muller | F42C 15/22 102/482 |
| 9,103,638 | B2 * | 8/2015 | Thomas | F42B 27/08 |
| 9,151,584 | B2 * | 10/2015 | Kapeles | F41H 9/00 |
| 9,261,339 | B2 * | 2/2016 | Mancini | F42B 27/00 |
| 9,989,341 | B2 * | 6/2018 | Robbins | F42B 12/46 |
| 2017/0102219 | A1 * | 4/2017 | Grassi | F42B 27/00 |

FOREIGN PATENT DOCUMENTS

| | | | |
|---|---|---|---|
| DE | 199 44 486 | C2 | 6/2003 |
| DE | 10 2008 058 776 | A1 | 5/2010 |
| DE | 10 2010 021 685 | A1 | 12/2011 |
| DE | 10 2010 052 209 | A1 | 5/2012 |
| DE | 202012002149 | U1 | 7/2012 |
| DE | 20 2013 003 957 | U1 | 4/2014 |
| EP | 2 940 421 | A1 | 11/2015 |
| WO | WO 94/08200 | A1 | 4/1994 |
| WO | WO 2010/044716 | A1 | 4/2010 |

* cited by examiner

STUN GRENADE HAVING AN ADJUSTABLE SWITCH MECHANISM TO CONNECT DIFFERENT EFFECT CHAMBERS SIMULTANEOUSLY TO A DELAY SET

This nonprovisional application is a continuation of International Application No. PCT/EP2018/060031, which was filed on Apr. 19, 2018, and which claims priority to German Patent Application No. 10 2017 108 938.1, which was filed in Germany on Apr. 26, 2017, and which are both herein incorporated by reference.

BACKGROUND OF THE INVENTION

Field of the Invention

The present invention relates to a stun grenade, in particular to the possibility for individual adjustment and situation-dependent, or situation-induced, adaptation of the number of active masses in situ. Active masses are understood to mean cracks, flashes of light, noises (e.g. whistling signal), etc., in other words, so-called shock effects. Furthermore, the invention relates to a safety mechanism designed to prevent accidental detonation of the stun grenade.

Description of the Background Art

Stun grenades are used for non-lethal protection and defense against individuals and are also used for support during police operations. They are similar to hand grenades which are usually detonated manually and then thrown, but should not cause fragmentation.

DE 199 44 486 C2, which corresponds to U.S. Pat. No. 6,595,139, discloses a stun grenade for manual detonation and throwing which has a cylindrical container comprising a plurality of compartments running parallel to the center axis of the container which can accommodate effect charges. Detonation of the effect charges takes place using a manually actuable detonation device on one side of the cylindrical container. Following detonation, all effect charges in the container are detonated in a timed sequence, i.e. with a time lag, and fired off radially outwards. DE 92 13 375 U1, which is cited in this document, describes a stun grenade which provides charge containers for receiving the respective delay and effect charge in the compartments. The effect charges are then detonated in sequence by these delay charges which have different delay times.

DE 10 2008 058 776 A1, which corresponds to U.S. Pat. No. 8,091,480, which is incorporated herein by reference, discloses a stun grenade, also referred to as a shock weapon, with an additional effect. The receiving of an additional grenade in an existing free space in the stun grenade means that a further effect charge can be incorporated individually, and therefore optionally immediately prior to use, and the effectiveness can thereby be increased.

DE 10 2010 052 209 A1 characterizes a stun grenade which has a modular design. By selecting the corresponding module with a predetermined chamber size, the performance characteristic of the stun grenade can easily be varied and also increased.

A safety device as relocking device for a rocker arm detonator for a hand grenade can be inferred from DE 10 2010 021 685 B4, which corresponds to U.S. Pat. No. 8,752,485, which is incorporated herein by reference. This allows relocking after the stun grenade has been activated. A profile part with an expedient is used for this purpose, wherein the expedient forms a pin as the safety pin which, through rotation of the profile part, is pushed into a safety slot of the rocker arm detonator or detonator head.

EP 2 940 421 A1 discloses a rocker arm detonator with a detonator head which comprises a pivotably arranged firing pin which is acted upon by a firing pin spring and with a safety clip which is pivotably arranged in the same direction of rotation as the firing pin from a starting position in which it is pressed in the direction of the detonator head into a firing pin release position. It is provided here that in the case of a rocker arm detonator which is not in use, the firing pin spring is in its untensioned state and is tensioned by a separate tensioning lever (unstored energy fuze head). A tensioning lever that can be actuated from a non-operational position into an armed position is connected to the firing pin spring by means of a tensioning lever shaft in such a manner that the firing pin spring can be actuated from its untensioned state to its tensioned state only when the safety clip is in its starting position. The firing pin spring can be locked in its tensioned state by means of a securing mechanism.

DE 20 2013 003 957 U1 discloses a safety pin for a stun grenade. This safety pin is placed in a direction substantially perpendicular to the pivot axis of a rocker lever.

SUMMARY OF THE INVENTION

The invention provides in an exemplary embodiment a stun grenade that can be adapted in situ, in particular, and, specifically, the power or active power can be individually adjusted.

The invention is based on the idea of adapting the active power of the stun grenade via a switch mechanism via a detonator head of the stun grenade with which the number of effects can be activated by detonating the effect charge.

The stun grenade has a plurality of chambers with breakthrough bores, usually two, in each of which an effect charge is incorporated. The stun grenade also comprises a delay charge. For its part, the delay charge acts via so-called overflow bores and the breakthrough bores in the chamber on the effect charge in the chambers.

The inventive switch mechanism contains the delay charge. This measure enables the delay charge to be in a secured position having no contact with the chambers. This design offers, among other things, the advantage that the mounting of stun grenades of this kind is, in particular, more reliable, since the connection between the delay set and the effect charge is interrupted during mounting.

For the effect, the delay charge and effect charge must be aligned with one another through the overflow bores/breakthrough bore. In order to adopt this functional or active position, the switch mechanism containing the delay set is adjusted. The adjustment of the switch mechanism takes place by rotating the detonator head, for example. The switch mechanism exhibits a plurality of switch settings, wherein in possible intermediate positions it is ensured that no connection is made between the delay charge and chambers. The number of switch settings depends on the number of effects being adjusted. With a number of four adjustable effects, e.g. 2, 4, 6 and 12, the switch mechanism should comprise four switch settings. If there were six different, freely selectable effect variants, such as 1, 2, 4, 10, 12 or 1, 2, 3, 6, 9, 12, six switch settings would have to be provided.

The rotation or switching of the switch mechanism is preferably realized with a simultaneous depression of the detonator head. This measure has the advantage that the adjustment only takes place under pressure, i.e. deliberately. By releasing the detonator head in one of the switch settings, said detonator head is once again returned to its original position. In addition, a stop can be incorporated which prevents the detonator head in its intermediate settings from sliding back into its original position. This measure should prevent the stun grenade from becoming inoperative, since there is no functional connection between the delay charge and the effect charge in the intermediate setting.

The stun grenade is furthermore equipped with a built-in safety feature which prevents the stun grenade from being triggered when the switch mechanism is in a non-functional intermediate setting. If the switch mechanism is simultaneously rotated while the detonator head is being pushed down, a first safety mechanism is provided in such a manner that a rotary split pin is only released when the detonator head is engaged back in its original, upper, and therefore correct, position. This safety mechanism may, for example, involve a spring-loaded pressure piece which bridges an air gap between the detonator head and a housing of the stun grenade. When changing the active power, e.g. changing the number of cracks, the pressure piece is pressed into the detonator head.

This design allows the use of a further safety mechanism which is pressed into this gap during assembly and keeps the first safety mechanism permanently actuated. This second safety mechanism may comprise a plastic clip. In addition, this second safety mechanism prevents the striking piece from accidently striking the percussion cap by means of a lug projecting laterally into the detonator head. This second safety mechanism is only removed directly prior to use. It prevents any manipulation of the switch unit and rotary split pin.

So that a different number of chambers can be activated, the switch mechanism has multiple overflow bores on the circumference. The overflow bores are partially connected to one another via one or multiple grooves likewise introduced circumferentially. The groove or grooves in this case may, for example, be spiral-shaped or cascade-shaped. Alternatives are known to the person skilled in the art. The pitch of the spirals or the gaps within the cascade (steps) are dependent on the position of the breakthrough bores in the chambers in this case, with which the corresponding overflow bores are to be brought into functional contact.

The present stun grenade, in this case a multi-bang, allows individual adjustment of the active power through adjustment of the number of cracks, crack/flashes and/or flash effects, as a result of which multiple freely selectable crack variants are created. In order to achieve an individual adjustment possibility for the active power of the stun grenade, it is proposed with the present invention that a switch mechanism should be incorporated in the stun grenade which allows the simultaneous activation of different chambers within the stun grenade, in order to adjust the effect by activating the individual active masses into a total active mass. The switch mechanism is formed by a tube and bores and grooves integrated circumferentially which in some cases form a functional unit along with the bores. By means of the switch mechanism, a different number of chambers is activated in the stun grenade, as a result of which the active power can be increased or also reduced again.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
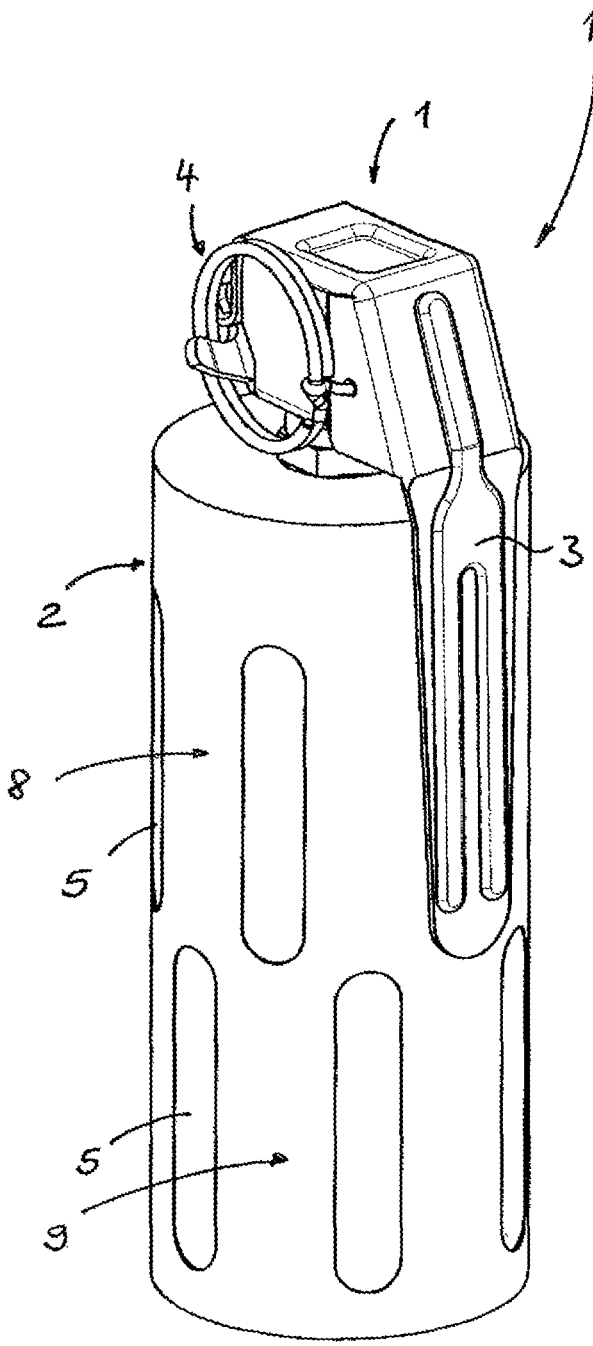
FIG. 1 shows a perspective representation of a stun grenade.
Figure 2:
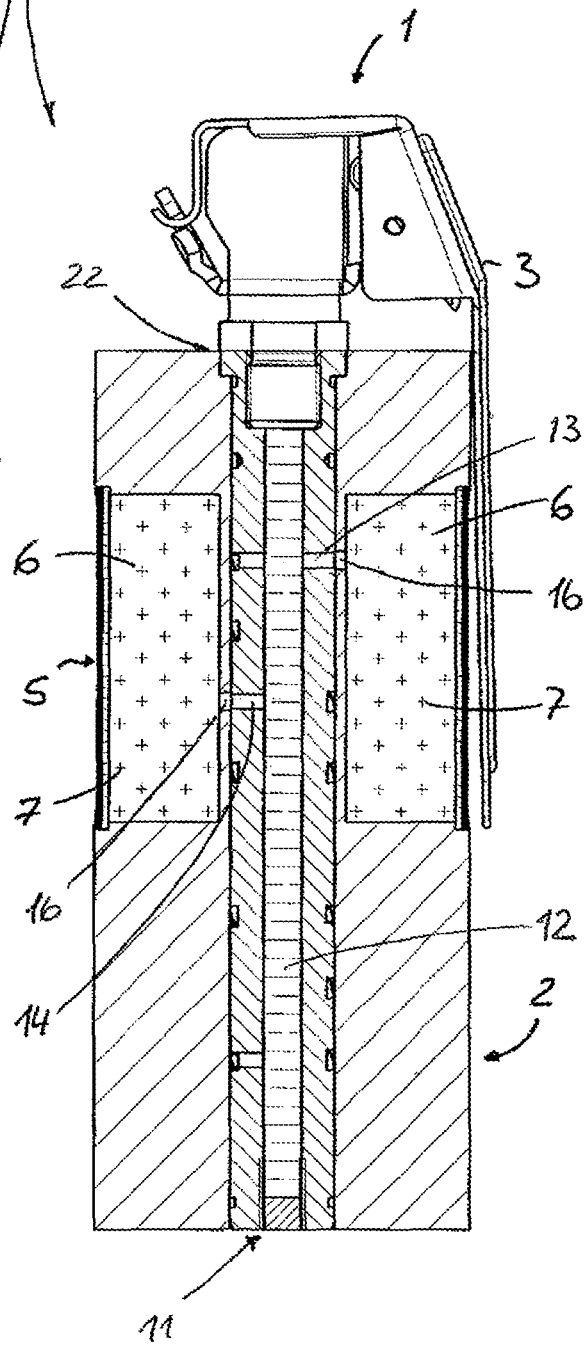
FIG. 2 shows a sectional representation of the stun grenade.

Depicted in FIG. 1 is a stun grenade 10 with a detonator head 1, a housing receiving 2 receiving the detonator head 1, a rocker lever 3 located on the detonator head 1, and a securing split pin 4 securing the rocker lever 3. In this exemplary embodiment, the stun grenade housing 2 has twelve blowout openings 5 circumferentially, wherein the perspective representation only reproduces six blowout openings 5. Stun grenades of this kind are also referred to as side blowers. The blowout openings 5 are each assigned a chamber 6 in which an effect charge 7 is contained (FIG. 2). The effect charges 7 in this exemplary embodiment are flash or crack charges. The chambers 6 in this exemplary embodiment are integrated in two planes 8, 9 within the stun grenade 10. The division in this case is preferably such that six chambers 6 are integrated in the upper level 8 and six chambers 6 in the lower level 9. The chambers 6 of the upper level 8 are preferably arranged offset to those of the lower level 9 in the housing 2.

As an alternative to the side blowers and the blowout openings 5 incorporated laterally in the housing 2, further blowout openings (not depicted in greater detail) can be provided in the base and cover of the housing 2 which are connected with the chambers via bores guided through the body of the stun grenade 10 (not depicted in greater detail) to the blowout openings in the cover and base. The lateral blowout openings 5 in this combined embodiment would have to be covered by an additional body or an additional housing (e.g. tube). It is also possible, however, for a stun grenade with chambers similar to DE 10 2004 059 991 B4, which corresponds to U.S. Pat. No. 7,721,651, which is incorporated herein by reference, without lateral blowout openings to be used. There are no restrictions in this respect.

Figure 3:
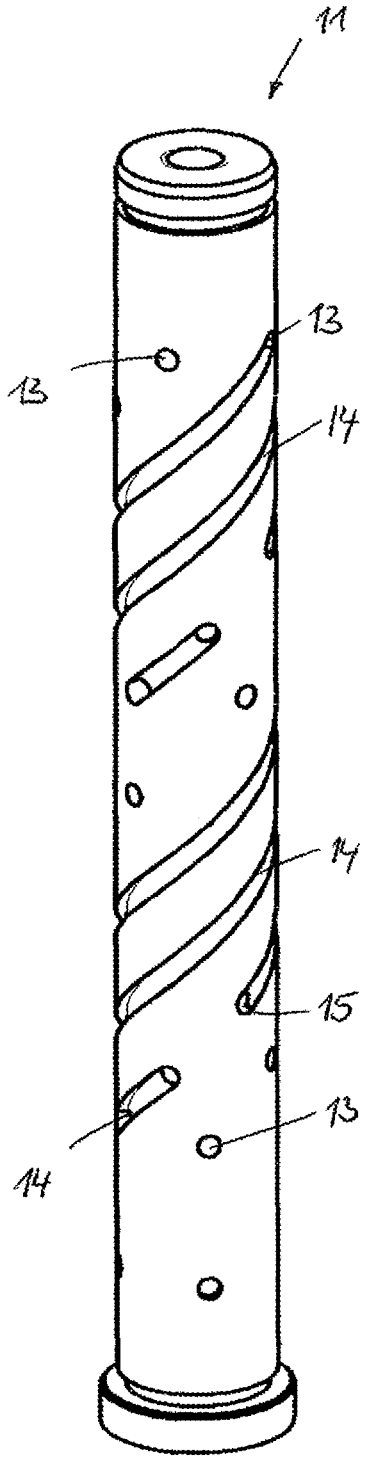
FIG. 3 shows a switch mechanism of the stun grenade.

In the housing 2 a (central) tube 11 is incorporated centrally between the chambers 6 (FIG. 3). This central tube 11 forms a switch mechanism of the stun grenade 10. In a particularly preferred embodiment, a delay charge 12 is pressed, for example, into the switch mechanism 11. The switch mechanism 11 or the center tube has one or multiple bores 13 circumferentially or one or multiple grooves or notches 14. The grooves 14 have groove starts, usually bores 13, and groove ends 15. These interact with the respective breakthrough bore 16 of the chambers 6 which are switched to the stun grenade 1 and customize it in terms of its effect. Accordingly, the grooves 13 are spiral-shaped or cascade-shaped. Other geometries for connecting the bores 13 introduced at different heights/levels in the switch mechanism 11 and the respective breakthrough bore 16 in the chamber 6 will be known to the person skilled in the art. The pitch or cascade, etc. of the groove 14 depends in this case on the position of the breakthrough bore 16 in the respective chamber 6 relative to the associated bore 13 in the switch mechanism 11.

Figure 4:
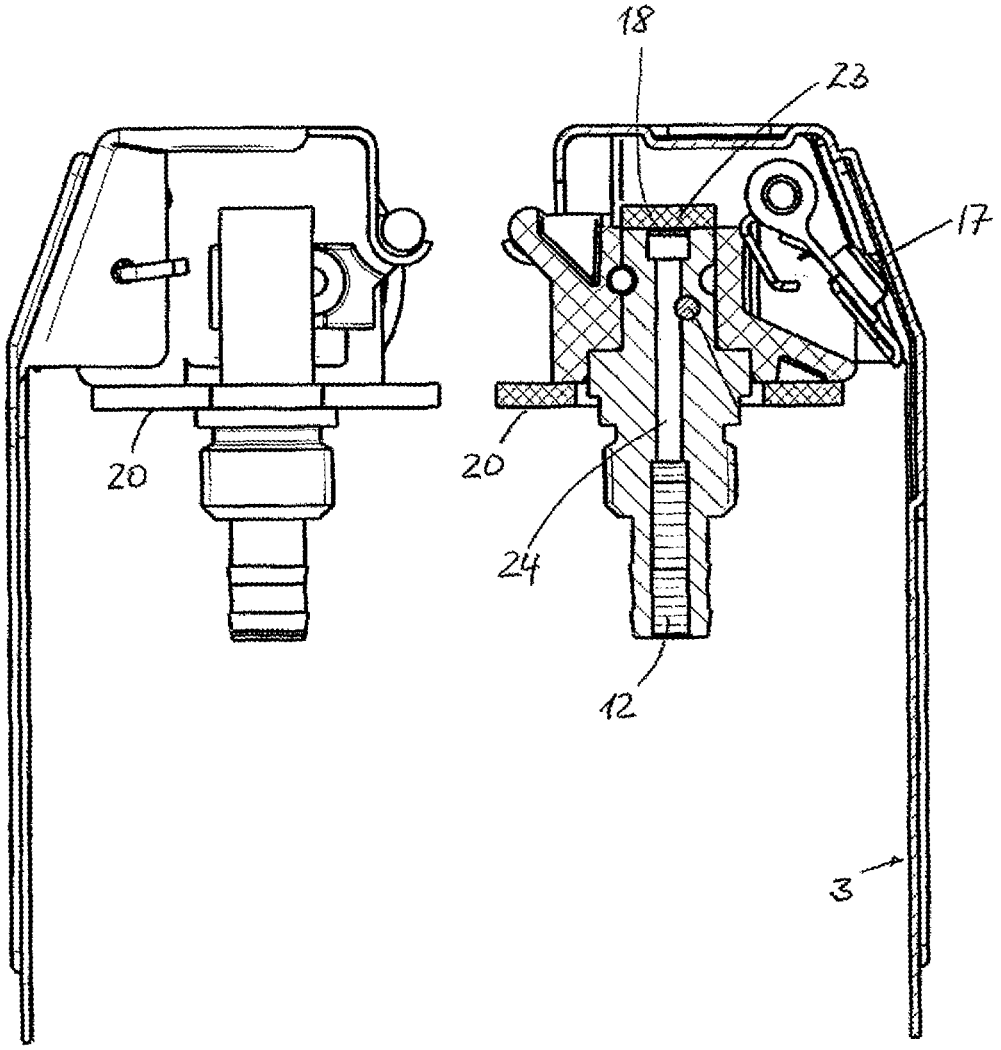
FIG. 4 shows a representation of a detonator head of the stun grenade.

FIG. 4 shows the detonator head 1 in a representation in which the rocker lever 3 is located on the left of the detonator head 1 and also in a sectional depiction in which the rocker lever 3 is located on the right of this. The rocker lever 3 is secured by the split pin 4 in a manner known in the art and prevents a spring-loaded detonator 17 firing pin or striking piece/detonator is actually a detonator, in other words an object with explosive material from striking a percussion cap 18.

Reference number 20 is used to denote a safety mechanism which is included between the switch mechanism 11 and the body, in particular the detonator head 1. This safety mechanism 20 may, in addition, cover the percussion cap 18. The safety mechanism 20, for example a plastic clip, is incorporated in an air gap 22 (approx. 2 mm) between the detonator head 1 and the housing 2 of the stun grenade 10 and bridges said gap. This safety mechanism 20 may comprise a plastic clip. In addition, this safety mechanism 20 has a lug 23 projecting laterally into the detonator head 1 which thereby covers the percussion cap 18. In this way, accidental striking of the detonator (striking piece) 17 firing pin or striking piece/detonator is actually a detonator, in other words an object with explosive material on the percussion cap 18 is prevented. The detonator 17 firing pin or striking piece/detonator is actually a detonator, in other words an object with explosive material would be able to strike no more than the lug 23 with the present safety mechanism 20.

A further safety mechanism not depicted in greater detail is used so that the split pin 4 can be pulled and the rocker lever 3 released only in the position in which the detonator head 1 has adopted its initial position. It is impossible to pull the split pin 4 in other states of the detonator head 1. This safety mechanism, also referred to as a split-pin safety mechanism, may be realized by a spring-loaded pressure piece, for example. It is thereby ensured that the split pin 4 can only be pulled and the rocker lever 3 released in the original or starting position of the detonator head 1.

The method of operation of the stun grenade 10 is as follows:

In order to adjust the individual active powers of the stun grenade 10, the switch mechanism 11 containing the delay set 12 is adjusted. The adjustment of the switch mechanism 11 preferably takes place by rotating the detonator head 1 which is mechanically connected to the switch mechanism 11. The switch mechanism 11 has a plurality of switch settings, wherein the number of switch settings is dependent on the number of effects to be adjusted or the possible combinations of effect charges 7, e.g. when selecting 2, 4, 8, 10, 12 effects=starting position+4 switch settings.

According to the desired number of effects, the number of chambers 6 is functionally connected to the delay set 12 through rotation. The functional connection between the delay charge 12 and the chambers 6 is made via the corresponding bores 13 and grooves 14 in the switch mechanism 11, which are aligned by turning the switch mechanism 11 (the detonator head 1) to the through-flow openings 16 of the chambers 6. The delay set 12 is detonated once the split pin 4 has been released and the detonator 17 struck firing pin or striking piece/detonator is actually a detonator, in other words an object with explosives the percussion cap 18. Slag which forms during this gets out through the bores 13 and is guided either directly or via the groove 14 to the breakthrough bore 16 of the connected chambers 6. The metals in the slag reach the chambers 6 and therefore come into contact with the effects 7 and detonate these (e.g. flash set) via the breakthrough bore 16. The implemented effect then passes out of the blowout openings 5 into the environment.

The rotation or switching of the switch mechanism 11 is preferably achieved with simultaneous pressing-down of the detonator head 1. By releasing the detonator head 1 in one of the prescribed and therefore permitted switch settings, said detonator head is once again moved into its original position. A spring, etc. can be provided for this purpose which is incorporated below the switch mechanism 11 in the housing 2, for example. Incorporation of a spring below the detonator head 1 is likewise conceivable.

The stun grenade 10 is secured by means of the two safety mechanisms 20 and the split-pin safety mechanism. The safety mechanism 20 is for its part pressed into the gap 22 during assembly, for example. This safety mechanism 20 keeps the second safety mechanism, for the split pin 4, permanently activated. In addition, by means of the lug 23 projecting laterally into the detonator head 1, this safety mechanism 20 prevents the detonator 17 from accidentally striking the percussion cap 18. This further safety mechanism 20 is only removed immediately prior to use. It prevents any manipulation of the switch unit (switch mechanism) and the split pin 4 (e.g. rotary split pin). Only following removal of the safety mechanism 20 is the split pin safety mechanism (pressure safety catch) released and releases the split pin 4.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A stun grenade comprising:

a detonator head;

a housing that receives the detonator head, the housing comprising chambers each having an effect charge therein and the chambers each having at least one breakthrough bore;

a rocker lever located on the detonator head;

a securing split pin to secure the rocker lever; and a switch mechanism arranged in the housing which, via rotational adjustment, functionally connects different chambers substantially simultaneously to a delay set, wherein the switch mechanism is a hollow cylindrical tube having the delay set disposed therein, the hollow cylindrical tube having radially extending bores and at least one spiral groove that is recessed in an exterior surface of the cylindrical hollow tube, and wherein a first one of the bores is provided at a first end of the at least one spiral groove and a second one of the bores is provided at a second end of the at least one spiral groove, such that in an adjustment position of the switch mechanism, the at least one breakthrough bore of each of at least two of the chambers are fluidly connected together with the first one of the bores, the second one of the bores and the at least one spiral groove.

2. The stun grenade as claimed in claim 1, wherein blowout openings are formed in the housing and are assigned to each of the chambers.

3. The stun grenade as claimed in claim 2, wherein the blowout openings are incorporated circumferentially in the housing and/or in a cover or a base of the housing.

4. The stun grenade as claimed in claim 1, wherein a safety mechanism is incorporated in an air gap formed between the detonator head and the housing.

5. The stun grenade as claimed in claim 4, wherein the safety mechanism is configured as a plastic clip having a lug projecting laterally into the detonator head to cover a percussion cap in the detonator head.

6. The stun grenade as claimed in claim 4, wherein a further safety mechanism in the form of a pressure piece is incorporated in the detonator head such that the securing split pin can only be drawn and the rocker lever released with the detonator head in a starting position.

7. The stun grenade as claimed in claim 1, wherein the switch mechanism is centrally aligned in the housing between the chambers.

8. The stun grenade as claimed in claim 1, wherein the switch mechanism is connected to the detonator head, such that the switch mechanism is rotatably adjustable by rotation of the detonator head.

* * * * *